US010472897B2

(12) United States Patent
Dunbar et al.

(10) Patent No.: US 10,472,897 B2
(45) Date of Patent: Nov. 12, 2019

(54) ADJUSTABLE DEPTH OF CUT CONTROL FOR A DOWNHOLE DRILLING TOOL

(71) Applicant: Halliburton Energy Services, Inc., Houston, TX (US)

(72) Inventors: Bradley David Dunbar, The Woodlands, TX (US); Seth Garrett Anderle, Spring, TX (US); Gregory Christopher Grosz, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 147 days.

(21) Appl. No.: 15/552,904

(22) PCT Filed: Mar. 25, 2015

(86) PCT No.: PCT/US2015/022441

§ 371 (c)(1),
(2) Date: Aug. 23, 2017

(87) PCT Pub. No.: WO2016/153499

PCT Pub. Date: Sep. 29, 2016

(65) Prior Publication Data

US 2018/0030786 A1 Feb. 1, 2018

(51) Int. Cl.

| | |
|---|---|
| ***E21B 10/42*** | (2006.01) |
| ***E21B 10/43*** | (2006.01) |
| ***E21B 10/62*** | (2006.01) |

(52) U.S. Cl.

CPC ..... *E21B 10/42* (2013.01); *E21B 10/43* (2013.01); *E21B 10/62* (2013.01)

(58) Field of Classification Search

CPC ..... E21B 10/42; E21B 10/43; E21B 10/62; E21B 12/02

See application file for complete search history.

(56) References Cited

U.S. PATENT DOCUMENTS

| | | | |
|---|---|---|---|
| 5,791,409 | A | 8/1998 | Flanders |
| 6,142,250 | A | 11/2000 | Griffin et al. |
| 6,298,930 | B1 | 10/2001 | Sinor et al. |
| 6,394,198 | B1 | 5/2002 | Hall et al. |
| 7,946,357 | B2 | 5/2011 | Trinh et al. |

(Continued)

FOREIGN PATENT DOCUMENTS

| | | |
|---|---|---|
| WO | 2014/012038 | 1/2014 |

OTHER PUBLICATIONS

International Preliminary Report on Patentability for PCT Patent Application No. PCT/US2015/022441, dated Oct. 5, 2017; 10 pages.

(Continued)

*Primary Examiner* — Michael R Wills, III
(74) *Attorney, Agent, or Firm* — Baker Botts L.L.P.

(57) ABSTRACT

A drill bit may include a bit body, a plurality of blades on the bit body, and a plurality of cutting elements on the plurality of blades. The drill bit may also include an adjustable depth of cut controller (DOCC) located on a blade to provide depth of cut control for at least one of the plurality of cutting elements. Further, the drill bit may include a positioning unit coupled to the adjustable DOCC and configured to adjust the position of the DOCC relative to the cutting element based on a control signal from a control unit.

19 Claims, 9 Drawing Sheets

(56) References Cited

U.S. PATENT DOCUMENTS

| | | | | |
|---|---|---|---|---|
| 8,863,860 | B2 | 10/2014 | Chen et al. | |
| 9,181,756 | B2 * | 11/2015 | Schwefe | E21B 10/62 |
| 2001/0030063 | A1 | 10/2001 | Dykstra et al. | |
| 2004/0134687 | A1 | 7/2004 | Radford et al. | |
| 2005/0222571 | A1 | 10/2005 | Ryan | |
| 2009/0044979 | A1 * | 2/2009 | Johnson | E21B 7/06 175/24 |
| 2009/0145669 | A1 | 6/2009 | Durairajan et al. | |
| 2010/0071956 | A1 | 3/2010 | Beuershausen | |
| 2010/0212964 | A1 | 8/2010 | Beuershausen | |
| 2011/0247816 | A1 | 10/2011 | Carter et al. | |
| 2012/0111630 | A1 | 5/2012 | Chen et al. | |
| 2012/0255784 | A1 | 10/2012 | Hanford | |
| 2013/0238245 | A1 | 9/2013 | Chen et al. | |
| 2013/0270010 | A1 | 10/2013 | Haugvaldstad | |
| 2014/0027177 | A1 * | 1/2014 | Schwefe | E21B 10/62 175/40 |
| 2014/0027179 | A1 | 1/2014 | Schwefe et al. | |
| 2014/0097024 | A1 | 4/2014 | Haugvaldstad | |
| 2014/0174827 | A1 | 6/2014 | Schen et al. | |
| 2014/0311801 | A1 | 10/2014 | Jain et al. | |
| 2014/0332271 | A1 * | 11/2014 | Do | E21B 10/62 175/57 |
| 2017/0275951 | A1 * | 9/2017 | Thomas | E21B 10/42 |

OTHER PUBLICATIONS

Office Action for Great Britain Patent Application No. GB1713381.01, dated Oct. 20, 2017; 2 pages.

Office Action for Canadian Patent Application No. 2974093, dated Aug. 9, 2018; 5 pages.

International Search Report and Written Opinion, Application No. PCT/US2015/022441; 15 pgs.

* cited by examiner

ADJUSTABLE DEPTH OF CUT CONTROL FOR A DOWNHOLE DRILLING TOOL

RELATED APPLICATIONS

This application is a U.S. National Stage Application of International Application No. PCT/US2015/022441 filed Mar. 25, 2015, which designates the United States, and which is incorporated herein by reference in its entirety.

TECHNICAL FIELD

The present disclosure relates generally to downhole drilling tools and, more particularly, to adjustable depth of cut control for a downhole drilling tool.

BACKGROUND

Various types of tools are used to form wellbores in subterranean formations for recovering hydrocarbons such as oil and gas lying beneath the surface. Examples of such tools include rotary drill bits, hole openers, reamers, and coring bits. Rotary drill bits include, but are not limited to, fixed cutter drill bits, such as polycrystalline diamond compact (PDC) drill bits, drag bits, matrix drill bits, rock bits, and roller cone drill bits. A fixed cutter drill bit typically includes multiple blades each having multiple cutting elements, such as the PDC cutting elements on a PDC bit.

In a typical drilling application, a drill bit (either fixed-cutter or rotary cone) is rotated to form a wellbore. The drill bit is coupled, either directly or indirectly to a "drill string," which includes a series of elongated tubular segments connected end-to-end. An assembly of components, referred to as a "bottom-hole assembly" (BHA) may be connected to the downhole end of the drill string. In the case of a fixed-cutter bit, the diameter of the wellbore formed by the drill bit may be defined by the cutting elements disposed at the largest outer diameter of the drill bit. A drilling tool may include one or more depth of cut controllers (DOCCs). A DOCC is a physical structure configured to (e.g., according to their shape and relative positioning on the drilling tool) control the amount that the cutting elements of the drilling tool cut into or engage a geological formation. A DOCC may provide sufficient surface area to engage with the subterranean formation without exceeding the compressive strength of the formation to take load off of or away from the PDC cutting element limiting their depth or engagement. Conventional DOCCs are fixed on the drilling tool by welding, brazing, or any other suitable attachment method, and are configured to engage with the formation to maintain a pre-determined depth of cut which is determined based on ROP and RPM based on the compressive strength of a given formation.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

According to the present disclosure, a drill bit may include an adjustable depth of cut controller (DOCC), which may be designed to engage with the subterranean formation and control the depth of cut of the cutting elements on the drill bit. The adjustable DOCC may provide adjustable depth of cut control for a variety of conditions in the wellbore. For example, a drill bit may drill through geological layers of varying compressive strengths during a drilling operation, which may result in varying forces acting on the cutting elements based on the varying compressive strengths of the formation. The position of the DOCC with respect to one or more cutting elements may be adjusted during and/or between drilling operations. The adjustment of the position of the DOCC may change the surface area of the DOCC element that engages with the subterranean formation and may provide varying amounts of depth of cut control for corresponding cutting elements. Embodiments of the present disclosure and its advantages are best understood by referring to FIGS. 1-9, where like numbers are used to indicate like and corresponding parts.

Figure 1:
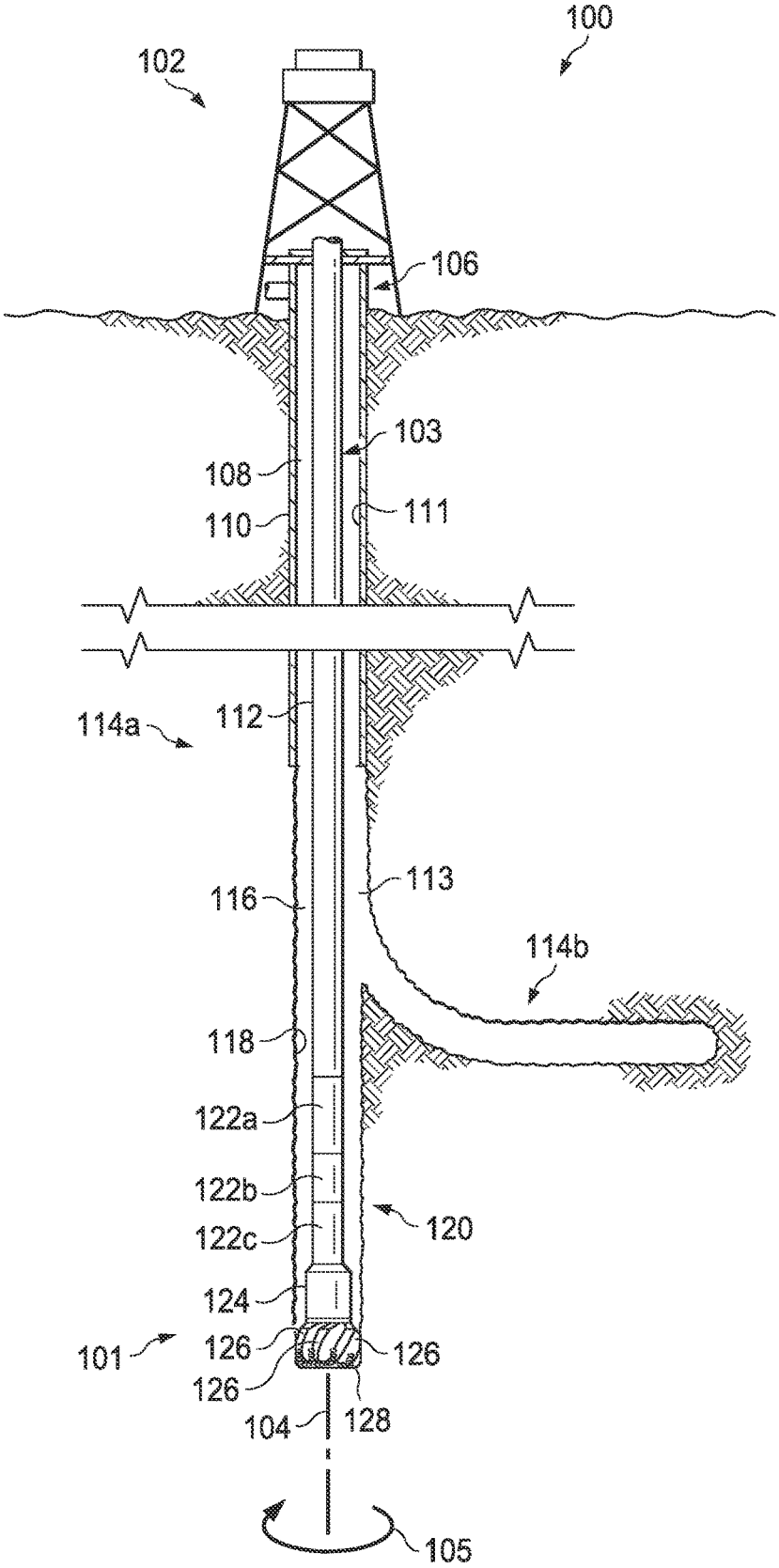
FIG. 1 illustrates an elevation view of an example embodiment of a drilling system.

FIG. 1 illustrates an elevation view of an example embodiment of drilling system 100. Drilling system 100 may include well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Drilling system 100 may also include drill string 103 associated with drill bit 101 that may be used to form a wide variety of wellbores or bore holes such as generally vertical wellbore 114*a* or generally horizontal wellbore 114*b* or any combination thereof. Various directional drilling techniques and associated components of bottom hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*. The term "directional drilling" may be used to describe drilling a wellbore or portions of a wellbore that extend at a desired angle or angles relative to vertical. The desired angles may be greater than normal variations associated with vertical wellbores. Directional drilling may also be described as drilling a wellbore deviated from vertical. The term "horizontal drilling" may be used to include drilling in a direction approximately ninety degrees (90°) from vertical.

BHA 120 may include a wide variety of components configured to form wellbore 114. For example, components 122*a*, 122*b* and 122*c* of BHA 120 may include, but are not limited to, drill bits (e.g., drill bit 101), coring bits, drill collars, rotary steering tools, directional drilling tools, downhole drilling motors, reamers, hole enlargers or stabilizers. The number and types of components 122 included in BHA 120 may depend on anticipated downhole drilling conditions and the type of wellbore that will be formed by drill string 103 and rotary drill bit 101. BHA 120 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools and/or any other commercially available well tool. Further, BHA 120 may also include a rotary drive (not expressly shown) connected to components 122*a*, 122*b* and 122*c* and which rotates at least part of drill string 103 together with components 122*a*, 122*b* and 122*c*.

Wellbore 114 may be defined in part by casing string 110 that may extend from well surface 106 to a selected downhole location. Portions of wellbore 114, as shown in FIG. 1, that do not include casing string 110 may be described as "open hole." Various types of drilling fluid may be pumped from well surface 106 through drill string 103 to attached drill bit 101. The drilling fluids may be directed to flow from drill string 103 to respective nozzles (depicted as nozzles 156 in FIG. 2) passing through rotary drill bit 101. The drilling fluid may be circulated back to well surface 106 through annulus 108 defined in part by outside diameter 112 of drill string 103 and inside diameter 118 of wellbore 114*a*. Inside diameter 118 may be referred to as the "sidewall" of wellbore 114*a*. Annulus 108 may also be defined by outside diameter 112 of drill string 103 and inside diameter 111 of casing string 110. Open hole annulus 116 may be defined as sidewall 118 and outside diameter 112.

Drilling system 100 may also include rotary drill bit ("drill bit") 101. Drill bit 101, discussed in further detail in FIG. 2, may include one or more blades 126 that may be disposed outwardly from exterior portions of rotary bit body 124 of drill bit 101. Blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may also include one or more depth of cut controllers (not expressly shown) configured to control the depth of cut of cutting elements 128. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

Figure 2:
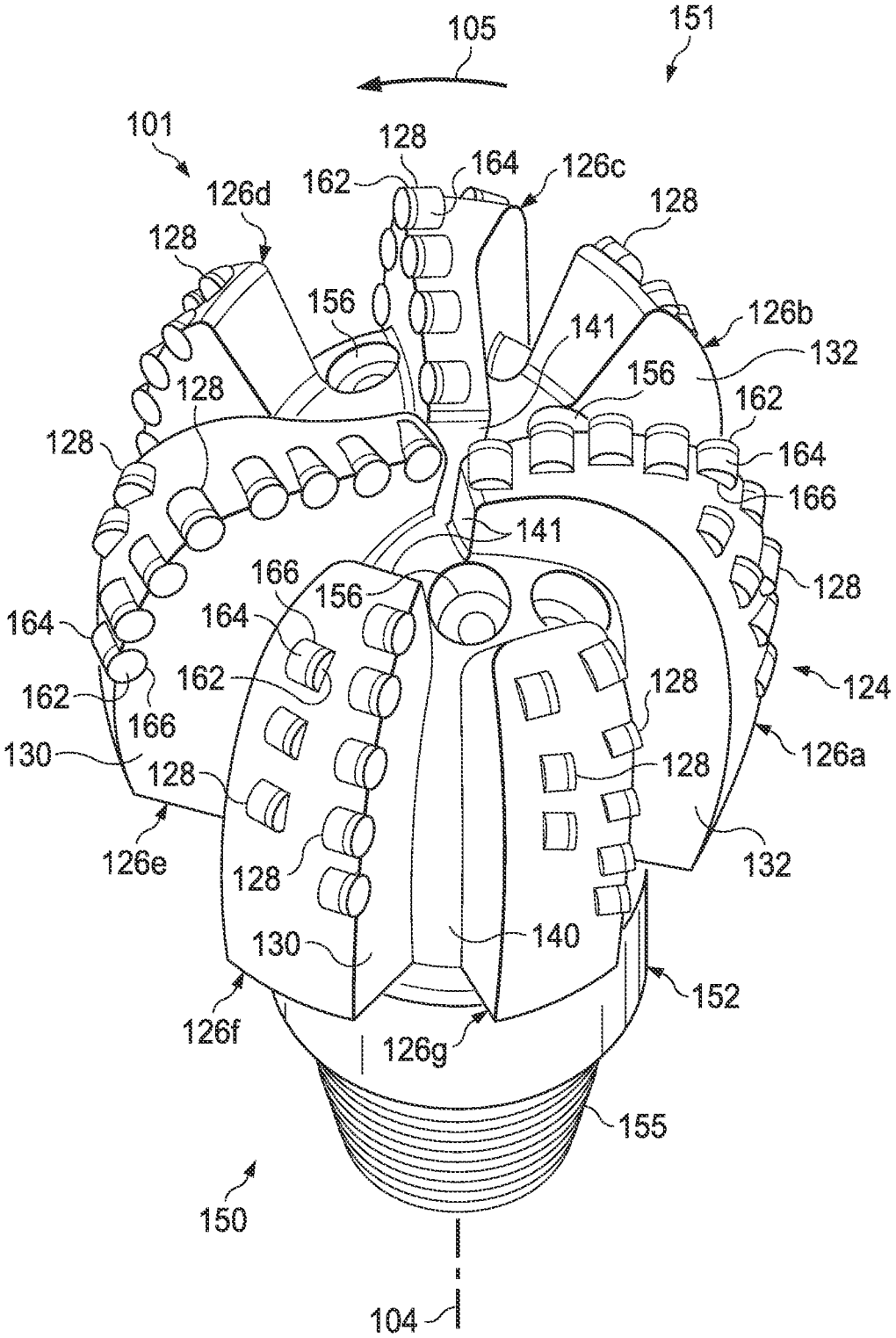
FIG. 2 illustrates an isometric view of a rotary drill bit oriented upwardly in a manner often used to design fixed cutter drill bits.

FIG. 2 illustrates an isometric view of a rotary drill bit oriented upwardly in a manner often used to design fixed cutter drill bits. Drill bit 101 may be any of various types of rotary drill bits, including fixed cutter drill bits, polycrystalline diamond compact (PDC) drill bits, drag bits, matrix drill bits, and/or steel body drill bits operable to form a wellbore (e.g., wellbore 114 as illustrated in FIG. 1) extending through one or more downhole formations. Drill bit 101 may be designed and formed in accordance with teachings of the present disclosure and may have many different designs, configurations, and/or dimensions according to the particular application of drill bit 101.

Drill bit 101 may include one or more blades 126 (e.g., blades 126*a*-126*g*) that may be disposed outwardly from exterior portions of bit body 124 of drill bit 101. Blades 126 may be any suitable type of projections extending outwardly from bit body 124. For example, a portion of blade 126 may be directly or indirectly coupled to an exterior portion of bit body 124, while another portion of blade 126 may be projected away from the exterior portion of bit body 124. Blades 126 formed in accordance with teachings of the present disclosure may have a wide variety of configurations including, but not limited to, substantially arched, generally helical, spiraling, tapered, converging, diverging, symmetrical, and/or asymmetrical. In some embodiments, one or more blades 126 may have a substantially arched configuration extending from proximate rotational axis 104 of drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit.

Each of blades 126 may include a first end disposed proximate or toward bit rotational axis 104 and a second end disposed proximate or toward exterior portions of drill bit 101 (e.g., disposed generally away from bit rotational axis 104 and toward uphole portions of drill bit 101). The terms "uphole" and "downhole" may be used to describe the location of various components of drilling system 100 relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Blades 126*a*-126*g* may include primary blades disposed about the bit rotational axis. For example, blades 126*a*, 126*c*, and 126*e* may be primary blades or major blades because respective first ends 141 of each of blades 126*a*, 126*c*, and 126*e* may be disposed closely adjacent to bit rotational axis 104 of drill bit 101. Blades 126*a*-126*g* may also include at least one secondary blade disposed between the primary blades. In the illustrated embodiment, blades 126*b*, 126*d*, 126*f*, and 126*g* on drill bit 101 may be secondary blades or minor blades because respective first ends 141 may be disposed on downhole end 151 of drill bit 101 a distance from associated bit rotational axis 104. The number and location of primary blades and secondary blades may vary such that drill bit 101 includes more or less primary and secondary blades. Blades 126 may be disposed symmetrically or asymmetrically with regard to each other and bit rotational axis 104 where the location of blades 126 may be based on the downhole drilling conditions of the drilling environment. Blades 126 and drill bit 101 may rotate about rotational axis 104 in a direction defined by directional arrow 105.

Each of blades 126 may have respective leading or front surfaces 130 in the direction of rotation of drill bit 101 and trailing or back surfaces 132 located opposite of leading surface 130 away from the direction of rotation of drill bit 101. Blades 126 may be positioned along bit body 124 such that they have a spiral configuration relative to bit rotational axis 104. Blades 126 may also be positioned along bit body 124 in a generally parallel configuration with respect to each other and bit rotational axis 104.

Blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126. By way of example and not limitation, cutting elements 128 may be various types of cutters, compacts, buttons, inserts, and gage cutters satisfactory for use with a wide variety of drill bits 101. Although FIG. 2 illustrates two rows of cutting elements 128 on blades 126, drill bits designed and manufactured in accordance with the teachings of the present disclosure may have one row of cutting elements or more than two rows of cutting elements.

Cutting elements 128 may be any suitable device configured to cut into a formation, including but not limited to, primary cutting elements, back-up cutting elements, secondary cutting elements or any combination thereof. Cutting elements 128 may include respective substrates 164 with a layer of hard cutting material (e.g., cutting table 162) disposed on one end of each respective substrate 164. The hard layer of cutting elements 128 may provide a cutting surface that may engage adjacent portions of a downhole formation to form wellbore 114 as illustrated in FIG. 1. The contact of the cutting surface with the formation may form a cutting zone (not expressly illustrated in FIGS. 1 and 2) associated with each of cutting elements 128. For example, the cutting zone may be formed by the two-dimensional area, on the face of a cutting element, that comes into contact with the formation, and cuts into the formation. The edge of the portion of cutting element 128 located within the cutting zone may be referred to as the cutting edge of a cutting element 128.

Each substrate 164 of cutting elements 128 may have various configurations and may be formed from tungsten carbide or other suitable materials associated with forming cutting elements for rotary drill bits. Tungsten carbides may include, but are not limited to, monotungsten carbide (WC), ditungsten carbide ($W_2C$), macrocrystalline tungsten carbide and cemented or sintered tungsten carbide. Substrates may also be formed using other hard materials, which may include various metal alloys and cements such as metal borides, metal carbides, metal oxides and metal nitrides. For some applications, the hard cutting layer may be formed from substantially the same materials as the substrate. In other applications, the hard cutting layer may be formed from different materials than the substrate. Examples of materials used to form hard cutting layers may include polycrystalline diamond materials, including synthetic polycrystalline diamonds. Blades 126 may include recesses or bit pockets 166 that may be configured to receive cutting elements 128. For example, bit pockets 166 may be concave cutouts on blades 126.

Blades 126 may also include one or more depth of cut controllers (DOCCs) (not expressly shown) configured to control the depth of cut of cutting elements 128. A DOCC may include an impact arrestor, a back-up or second layer cutting element and/or a Modified Diamond Reinforcement (MDR). Exterior portions of blades 126, cutting elements 128 and DOCCs (not expressly shown) may form portions of the bit face. As described in further detail below with reference to FIGS. 3-9, the position of the DOCC with respect to one or more cutting elements may be adjusted during and/or between drilling operations. The adjustment of the position of the DOCC may change the surface area of the DOCC that engages with the subterranean formation at a given depth of cut and may provide varying amounts of depth of cut control for corresponding cutting elements. Blades 126 may further include one or more gage pads (not expressly shown) disposed on blades 126. A gage pad may be a gage, gage segment, or gage portion disposed on exterior portion of blade 126. Gage pads may contact adjacent portions of a wellbore (e.g., wellbore 114 as illustrated in FIG. 1) formed by drill bit 101. Exterior portions of blades 126 and/or associated gage pads may be disposed at various angles (e.g., positive, negative, and/or parallel) relative to adjacent portions of generally vertical wellbore 114*a*. A gage pad may include one or more layers of hardfacing material.

Uphole end 150 of drill bit 101 may include shank 152 with drill pipe threads 155 formed thereon. Threads 155 may be used to releasably engage drill bit 101 with BHA 120 whereby drill bit 101 may be rotated relative to bit rotational axis 104. Downhole end 151 of drill bit 101 may include a plurality of blades 126*a*-126*g* with respective junk slots or fluid flow paths 140 disposed therebetween. Additionally, drilling fluids may be communicated to one or more nozzles 156.

A drill bit operation may be expressed in terms of depth of cut per revolution as a function of drilling depth. Depth of cut per revolution, or "depth of cut," may be determined by rate of penetration (ROP) and revolution per minute (RPM). ROP may represent the amount of formation that is removed as drill bit 101 rotates and may be expressed in units of ft/hr. Further, RPM may represent the rotational speed of drill bit 101. Actual depth of cut (Δ) may represent a measure of the depth that cutting elements cut into the formation during a rotation of drill bit 101. Thus, actual depth of cut may be expressed as a function of actual ROP and RPM using the following equation:

$$\Delta = ROP/(5*RPM)$$

Actual depth of cut may have a unit of in/rev.

The ROP of drill bit 101 is often a function of both weight on bit (WOB) and RPM. Referring to FIG. 1, drill string 103 may apply weight on drill bit 101 and may also rotate drill bit 101 about rotational axis 104 to form a wellbore 114 (e.g., wellbore 114*a* or wellbore 114*b*). For some applications a downhole motor (not expressly shown) may be provided as part of BHA 120 to also rotate drill bit 101.

Figure 3A:
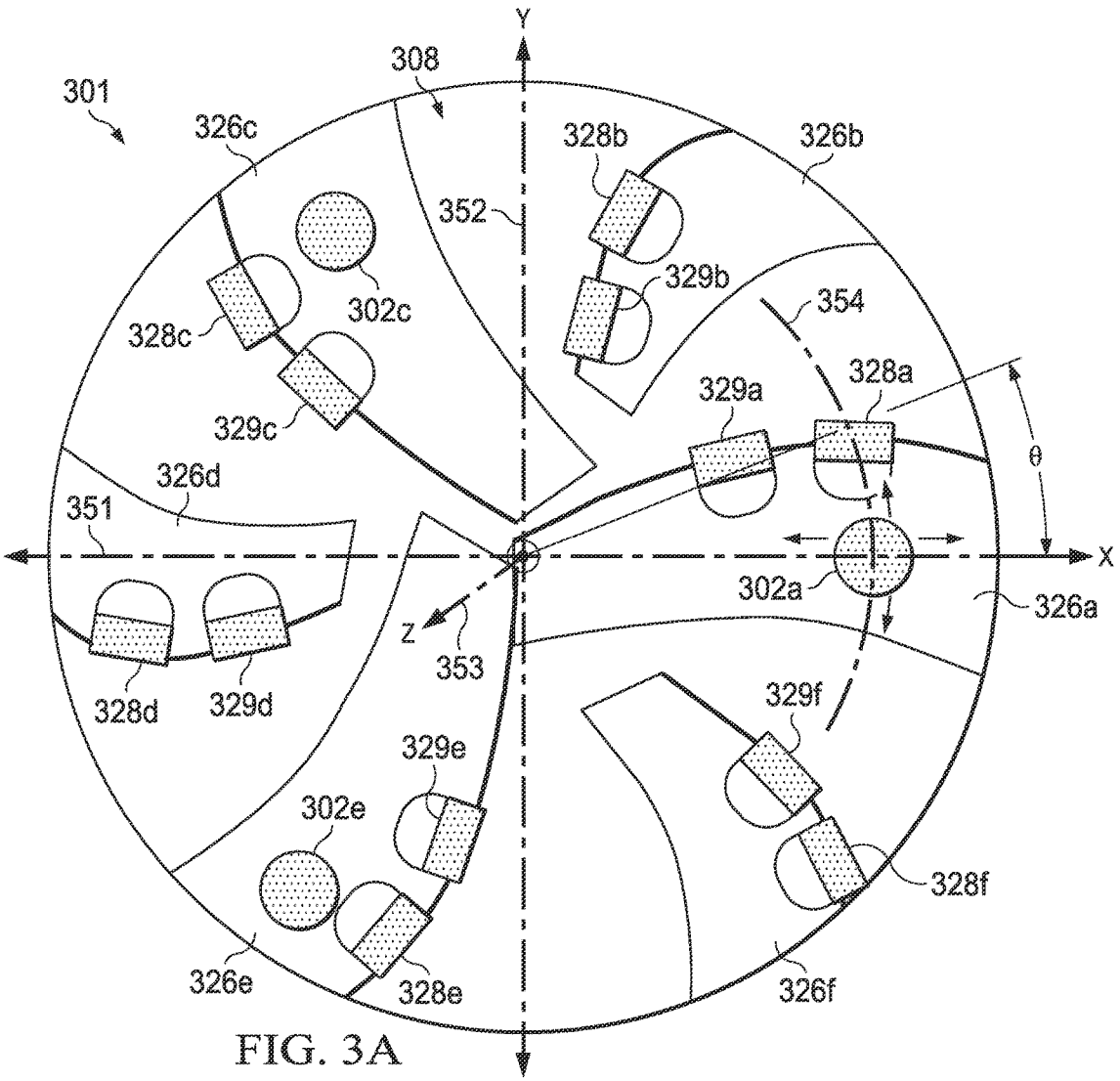
FIG. 3A illustrates a schematic drawing showing various components of a bit face or cutting face disposed on a drill bit or other downhole drilling tool.

FIG. 3A illustrates a bottom view of a bit face showing various components of the bit face disposed on a drill bit or other downhole drilling tool. Drill bit 301 includes DOCCs 302 (e.g., DOCCs 302*a*, 302*c*, and 302*e*) configured to control the depth of cut of cutting elements 328 and 329 (e.g., cutting elements 328*a*-328*f* and 329*a*-329*f*) disposed on blades 326 (e.g., blades 326*a*-326*f*) of drill bit 301.

To provide a frame of reference, FIG. 3A includes z-axis 353 that represents the rotational axis of drill bit 301. A coordinate or position corresponding to the z-axis may be referred to as an axial coordinate or axial position. FIG. 3A also includes x-axis 351, that represents the radial axis of drill bit 301. A coordinate or position corresponding to the x-axis may be referred to as a radial coordinate or position. Additionally, a location along the bit face of drill bit 301 shown in FIG. 3A may be described by x and y coordinates of the xy-plane illustrated by x-axis 351 and y-axis 352. The xy-plane may be substantially perpendicular to z-axis 353 such that the xy-plane of FIG. 3A may be substantially perpendicular to the rotational axis of drill bit 301.

DOCCs 302 may be configured such that the position of DOCCs 302 on blades 326*a* may be adjusted. As illustrated in FIG. 3A, DOCC 302*a* may have a position on blade 326*a* that may be adjusted in any suitable direction. For example, the position of DOCC 302*a* may be adjusted by moving DOCC 302*a* on blade 326*a* along x-axis 351. Likewise, the position of DOCC 302*a* may be adjusted by moving DOCC 302*a* on blade 326*a* in a direction parallel to y-axis 352, which may be tangential to the arc of the rotational path of the drill bit. Further, the position of DOCC 302*a* may be adjusted by moving DOCC 302*a* on blade 326*a* in a direction along rotational path 354, which may track the path of cutting element 328*a* as drill bit 301 rotates about rotational axis 353. Although DOCC 302*a* is illustrated as being located on the same blade as cutting element 328*a*, adjustable DOCCs such as DOCC 302*a* may also provide depth of cut control for one or more cutting elements located on one or more different blades of drill bit 301.

The amount of depth of cut control provided by DOCC 302*a* may depend in part on the angular distance (θ) between cutting element 328*a* and DOCC 302*a*. Adjusting the position of DOCC 302*a*, for example along rotational path 354 or in a direction parallel to y-axis 352, may alter the angular distance (θ) between cutting element 328*a* and DOCC 302*a*. Accordingly, as shown by FIGS. 3B and 3C, adjusting the position of DOCC 302*a* in such a manner may alter the amount of depth of cut control provided by DOCC 302*a*.

Figure 3B:
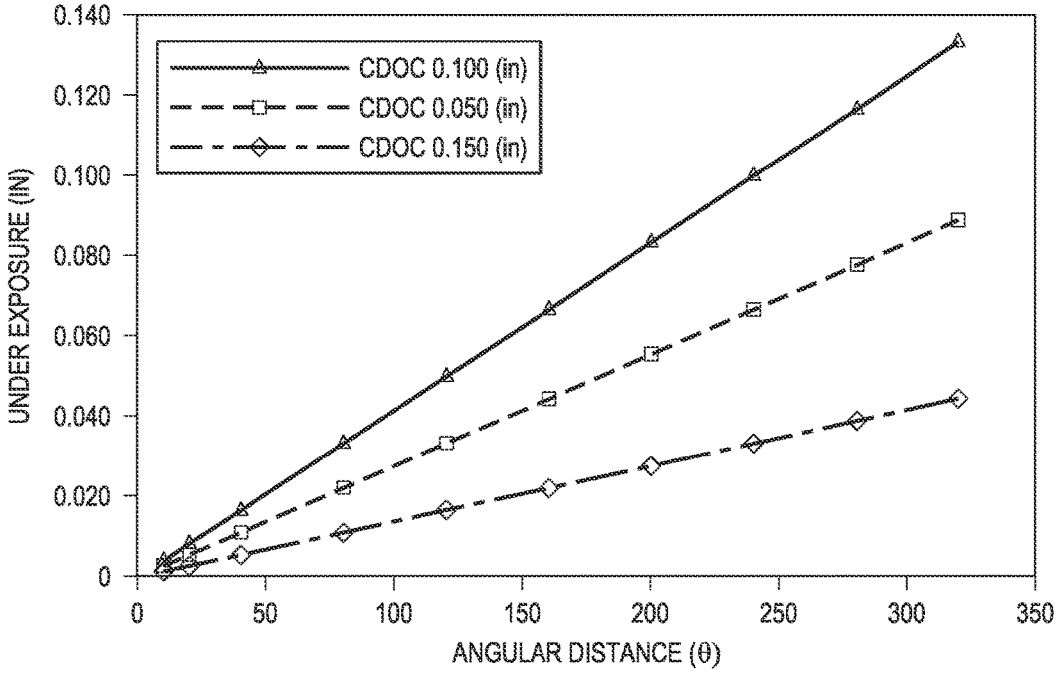
FIGS. 3B and 3C illustrate a relationship between the angular distance from a DOCC to a primary cutting element and the amount of depth of cut control for the DOCC.
Figure 3C:
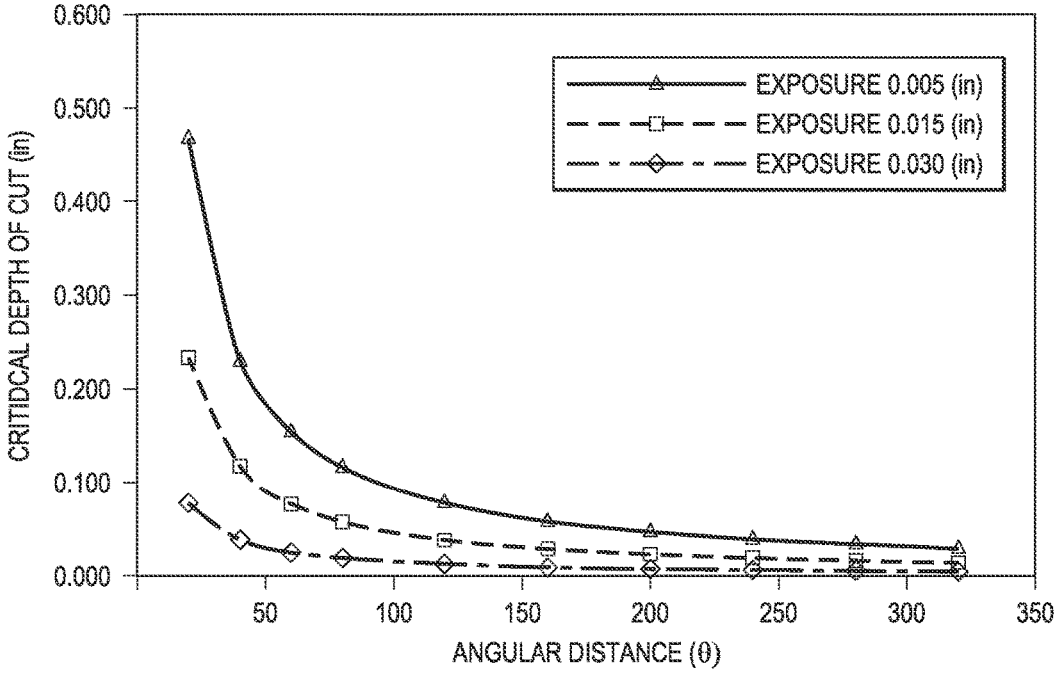

FIGS. 3B and 3C illustrate a relationship between the angular distance (θ) from a DOCC (e.g., DOCC 302*a*) to a primary cutting element (e.g., cutting element 328*a*) and the amount of depth of cut control (i.e., the critical depth of cut (CDOC)) for that DOCC. For example, as shown in FIG. 3B, the amount of under exposure for the DOCC, as compared to the cutting element, that is required to achieve a given CDOC increases as the angular distance (θ) between the cutting element and the DOCC increases. Further, as shown in FIG. 3C, the CDOC for a given under exposure of the DOCC, as compared to the cutting element, decreases in an inverse exponential manner as the angular distance (θ) between the cutting element and the DOCC increases. Although FIGS. 3B and 3C illustrate the relationship between the angular distance (θ) and CDOC for a single cutting element and a single DOCC, a DOCC may overlap the rotational path of multiple cutting elements and thus may impact the CDOC for each of multiple cutting elements.

Adjusting the radial position of DOCC 302*a*, for example along x-axis 351, may also impact the amount of depth of cut control provided by DOCC 302*a* for cutting element 328*a* and/or other cutting elements such as cutting elements 329*a*. For example, DOCC 302*a* may be positioned behind cutting element 328*a*, in the rotational path of cutting element 328*a*, to provide depth of cut control for cutting element 328*a*. Alternatively, DOCC 302*a* may be positioned behind cutting element 329*a*, in the rotational path of cutting element 329*a*, to provide depth of cut control for cutting element 329*a*. DOCC 302*a* may also be positioned to overlap the rotational paths of multiple cutting elements on one or more blades of drill bit 301, thus providing depth of cut control for each of the multiple cutting elements. For example, DOCC 302*a* may be sized and positioned to at least partially overlap the rotational paths of both cutting elements 328*a* and 329*a* in order to provide depth of cut control for each of cutting elements 328*a* and 329*a*.

Modifications, additions or omissions may be made to FIG. 3A without departing from the scope of the present disclosure. For example, although DOCCs 302 are depicted as being substantially round, DOCCs 302 may be configured to have any suitable shape depending on the design constraints and considerations of DOCCs 302. Additionally, although drill bit 301 includes a specific number of DOCCs 302 and a specific number of blades 326, drill bit 301 may include more or fewer DOCCs 302 and more or fewer blades 326. DOCCs 302 can be made of any suitable material depending on the design constraints and considerations of DOCCs 302. Further, any suitable DOCC (e.g., DOCC 302*c*, DOCC 302*e*) may have a position that may be adjustable as described above with reference to DOCC 302*a*. Exemplary mechanisms by which the respective positions of one or more DOCCs (such as DOCC 302*a*) may be adjusted are described in detail below with reference to FIG. 4A through FIG. 9.

Figure 4A:
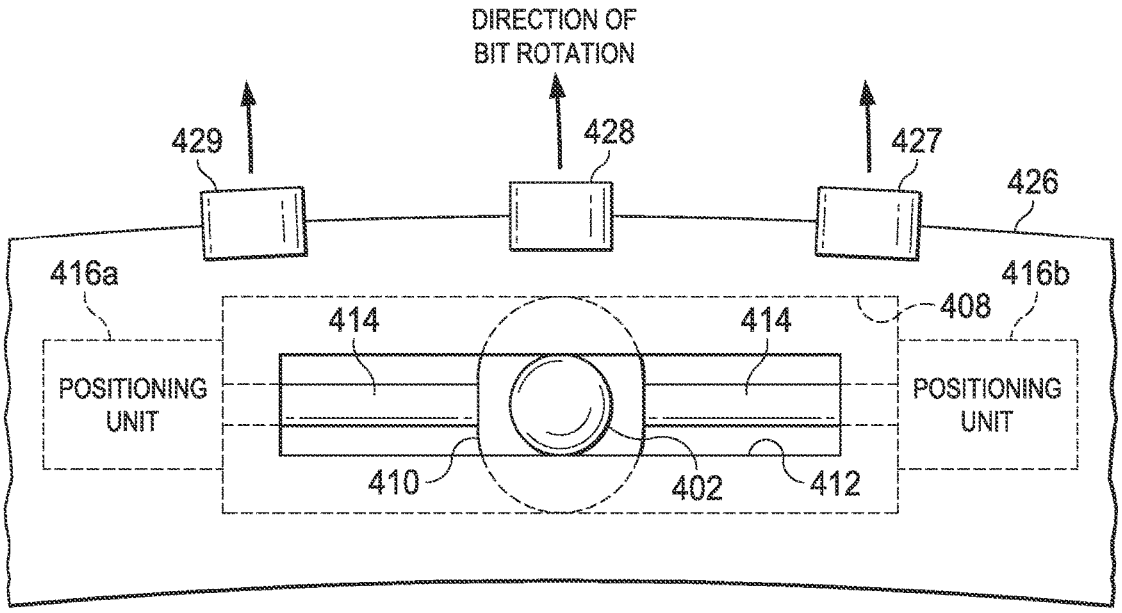
FIG. 4A illustrates a bottom view of an adjustable DOCC disposed on a portion of a blade that may be located on an downwardly oriented drill bit.
Figure 4B:
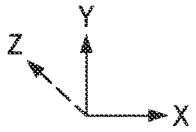
FIG. 4B illustrates a side cross-sectional view of an adjustable DOCC disposed on a portion of a blade.
Figure 4B:
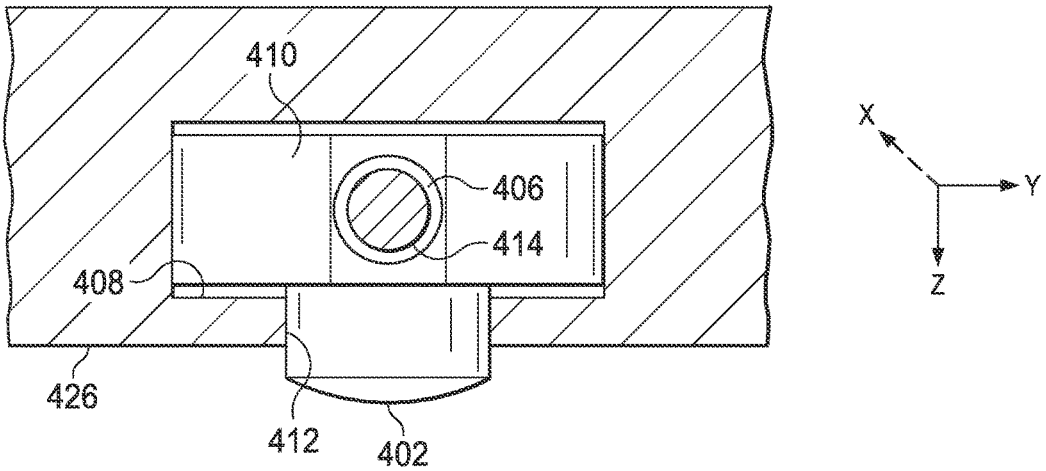

FIG. 4A illustrates a bottom view of adjustable DOCC 402 disposed on a portion of blade 426 that may be located on an downwardly oriented drill bit. FIG. 4B illustrates a side cross-sectional view of adjustable DOCC 402 disposed on a portion of blade 426.

As shown in FIG. 4A, cutting elements 427, 428, and 429 may be disposed on blade 426. Blade 426 may include slotted opening 412 through which DOCC 402 may protrude. Slotted opening 412 may extend across a radial width of blade 426 that spans the radial positions of multiple cutting elements. Further, DOCC 402 may be positioned at any location along slotted opening 412. For example, opening 412 may extend across a width of blade 426 such that adjustable DOCC 402 may be positioned behind any one of cutting elements 427, 428, and 429.

As shown in FIG. 4B, DOCC 402 may include base portion 410 that extends into blade 426. Base portion 410 may fit within inner cavity 408 of blade 426. Base portion 410 and inner cavity 408 may have a width larger than slotted opening 412 through which adjustable DOCC 402 may protrude. Accordingly, base portion 410 may be retained within inner cavity 408, and adjustable DOCC 402 may be coupled in an adjustable manner to blade 426.

Referring back to FIG. 4A, the position of adjustable DOCC 402 may be adjusted by rod 414. For example, rod 414 may be coupled to base portion 410 of DOCC 402. Positioning units 416*a* and 416*b* may each include a hydraulic motor configured to exert a hydraulic force on the respective sides of rod 414. For example, a first hydraulic motor in positioning unit 416*a* may assert a hydraulic force on one end of rod 414 to push adjustable DOCC from a location behind cutting element 428 to a location behind cutting element 427. Likewise, a second hydraulic motor in positioning unit 416*b* may assert a hydraulic force on an opposing end of rod 414 to push DOCC from a location behind cutting element 428 to a location behind cutting element 429.

In another example, a force may be applied to rod 414 by any other suitable type of motor rather than, or in addition to, the one or more hydraulic motors. For example, positioning units 416*a* and 416*b* may include an electromechanical motor in place of, or in addition to, a hydraulic motor.

In example implementations utilizing motors within positioning unit 416, rod 414 may be threaded and may extend through a threaded channel of DOCC 402. For example, as shown in FIG. 4B, a threaded implementation of rod 414 may extend through threaded channel 406 of base portion 410 of DOCC 402. The threads of threaded channel 406 may engage with the threads of rod 414. Accordingly, the position of DOCC 402 along the x-axis may be adjusted when rod 414 is rotated by one or more motors in positioning units 416*a* and/or 416*b*.

Although FIG. 4B illustrates two positioning units 416*a* and 416*b*, a single positioning unit 416 may be placed at any suitable location on blade 426 and may be coupled, either directly or indirectly, to adjustable DOCC 402 in a manner allowing the single positioning unit 416 to adjust the position of adjustable DOCC 402. Moreover, one or more position units 416 may draw power from a stand-alone device such as a stand-alone electromechanical motor or a stand-alone hydraulic motor, or may draw power from a separate subsystem within the drill bit and/or drill string.

In operation, the position of adjustable DOCC 402 may be adjusted between active drilling runs. The position of the adjustable DOCC 402 during each drilling operation may be determined based on the desired depth of cut control for that drilling operation. For example, a first amount of depth of cut control may be optimal during a first drilling operation in which a drill bit cuts through a layer of a first type of rock in a subterranean formation. Accordingly, the position of DOCC 402 may be set to a first position (e.g., behind cutting element 428) prior to a first drilling operation to provide the desired first amount of depth of cut control during the first drilling operation. After the first drilling operation has been completed, and the drill bit on which blade 426 may be located has ceased rotating, the position of adjustable DOCC 402 may be adjusted. For example, a second amount of depth of cut control may be optimal during a second drilling operation in which the drill bit may cut through a layer of a second type of rock in the subterranean formation. Accordingly, the position of adjustable DOCC 402 may be set to a second position (e.g., behind cutting element 429) prior to a second drilling operation to provide the desired second amount of depth of cut control during the second drilling operation. The adjustment of the position of adjustable DOCC 402 may subsequently be repeated any suitable number of times to provide the desired amount of depth of cut control for any suitable number of drilling operations. For example, the position of DOCC 402 may be set to a third position (e.g., behind cutting element 427, or at any other location along slotted opening 412). Further, although the position of adjustable DOCC 402 may be set to a location behind a cutting element (e.g., cutting elements 427, 428, or 429) on the same blade as DOCC 402, the position of adjustable DOCC 402 may also be set to a radial position that may align with or otherwise overlap the radial position of one or more cutting elements that may be located on another blade (e.g., a leading blade or a trailing blade) of the drill bit.

As shown in FIG. 4A, positioning units 416*a* and 416*b* may be located internally within blade 426, adjacent to the respective ends of internal cavity 408. Positioning units 416*a* and 416*b* may receive control signals for setting the position of adjustable DOCC 402 from a control unit located remotely from the drill bit on which blade 426 may be disposed. For example, a control unit may be located at the surface of a drilling rig (e.g., drilling rig 102 as shown in FIG. 1) and may transmit control signals through a drill string to the drill bit on which blade 426 may be disposed. Accordingly, the position of adjustable DOCC 402 may be adjusted either during or between drilling runs without removing the drill bit from a wellbore. Alternatively, the drill bit on which blade 426 may be disposed may be removed from a wellbore, and coupled to a control unit between drilling runs to set the position of adjustable DOCC 402. Positioning units 416*a* and 416*b* may also receive control signals from a control unit in the drill bit. Such a control unit in the drill bit may control one or more positioning units to adjust the position of adjustable DOCC 402 during drilling runs and/or between drilling runs.

Although FIG. 4A illustrates a configuration whereby the position of adjustable DOCC 402 may be adjusted along an axis approximately parallel to the x-axis, or approximately perpendicular to the y-axis or the direction of bit rotation, the features associated with adjustable DOCC 402 may be oriented on blade 426 at any suitable angle to allow for the position of adjustable DOCC to be adjusted along any suitable axis. For example, positioning units 416*a-b*, internal cavity 408, rod 414, slotted opening 412, may be rotated together by approximately ninety degrees. In such an example implementation, adjustable DOCC 402 may be configured to have a position that may be adjustable along an axis approximately parallel to the y-axis, which may be tangential to the arc of the rotational path of the drill bit.

Figure 5A:
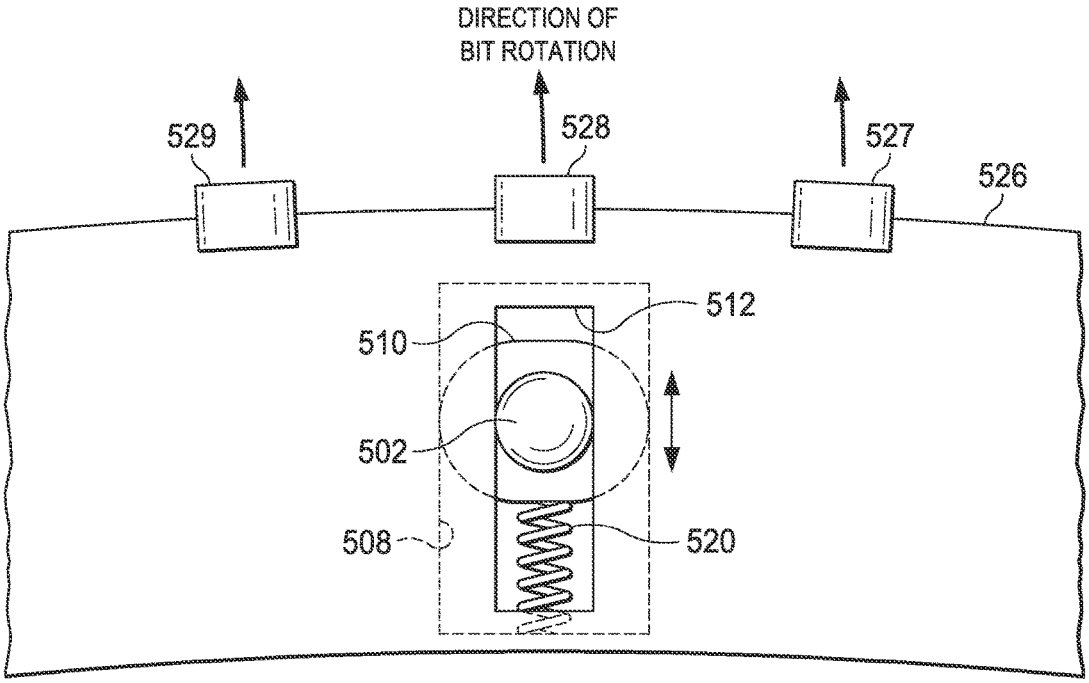
FIG. 5A illustrates a bottom view of a DOCC disposed on a portion of a blade that may be located on an downwardly oriented drill bit.
Figure 5B:
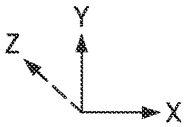
FIG. 5B illustrates a side cross-sectional view of a DOCC disposed on a portion of a blade.
Figure 5B:
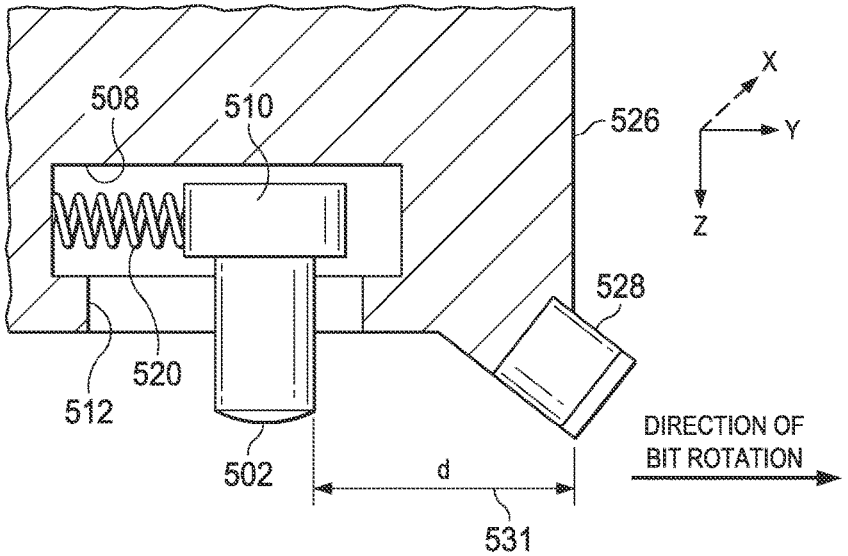

FIG. 5A illustrates a bottom view of DOCC 502 disposed on a portion of blade 526 that may be located on an downwardly oriented drill bit. FIG. 5B illustrates a side cross-sectional view of DOCC 502 disposed on a portion of blade 526.

As shown in FIG. 5A, cutting elements 527, 528, and 529 may be disposed on blade 526. Blade 526 may include slotted opening 512 through which DOCC 502 may protrude. Slotted opening 512 may span a range of positions behind cutting element 528. Further, DOCC 502 may be positioned at any location along slotted opening 512.

As shown in FIG. 5B, DOCC 502 may include base portion 510 that extends into blade 526. Base portion 510 may fit within inner cavity 508 of blade 526. Base portion 510 and inner cavity 508 may have a width larger than the slotted opening 512 through which DOCC 502 may protrude. Accordingly, base portion 510 may be retained within inner cavity 508, and DOCC 502 may be coupled in an adjustable manner to blade 526.

DOCC 502 may be coupled to spring 520, which may be oriented to provide a biasing force to DOCC 502. During a drilling operation, a frictional force may act on DOCC 502 as a result of DOCC 502 interacting with the wellbore being drilled. For the purposes of the present disclosure, a frictional force acting on a DOCC may also be referred to as a frictional force incurred by a DOCC. The frictional force acting on DOCC 502 may operate to push DOCC 502 against the biasing force of spring 520. The amount of frictional force acting on DOCC 502 during the drilling operation may increase as the distance (d) 531 between DOCC 502 and the tip of cutting element 528 increases. Further, the amount of biasing force provided by spring 520 may increase as spring 520 compresses. Accordingly, during drilling operations, DOCC 502 may move along an axis approximately parallel to the y-axis to an equilibrium point where the frictional force acting on DOCC 502 due to drilling equals the biasing force from spring 520.

The amount of depth of cut control provided by DOCC 502 for cutting element 528 may be a function of the amount of friction acting on DOCC 502 during a drilling operation.

For example, DOCC 502 may be positioned at an equilibrium point along an axis parallel to the y-axis where the amount of friction acting on DOCC 502 during drilling may be equal to the biasing force provided by spring 520. Accordingly, the amount of depth of cut control provided by DOCC 502 may be a function of the spring constant of spring 520. Spring 520 may be implemented with any suitable spring to provide a desired spring constant, and thus to provide a desired depth of cut control. Spring 520 may be implemented, for example, by a coil spring, a Belleville spring, a wave spring, hydraulic elements, or a low modulus material or a material with high elasticity that may deform under load (e.g., rubber).

Figure 6A:
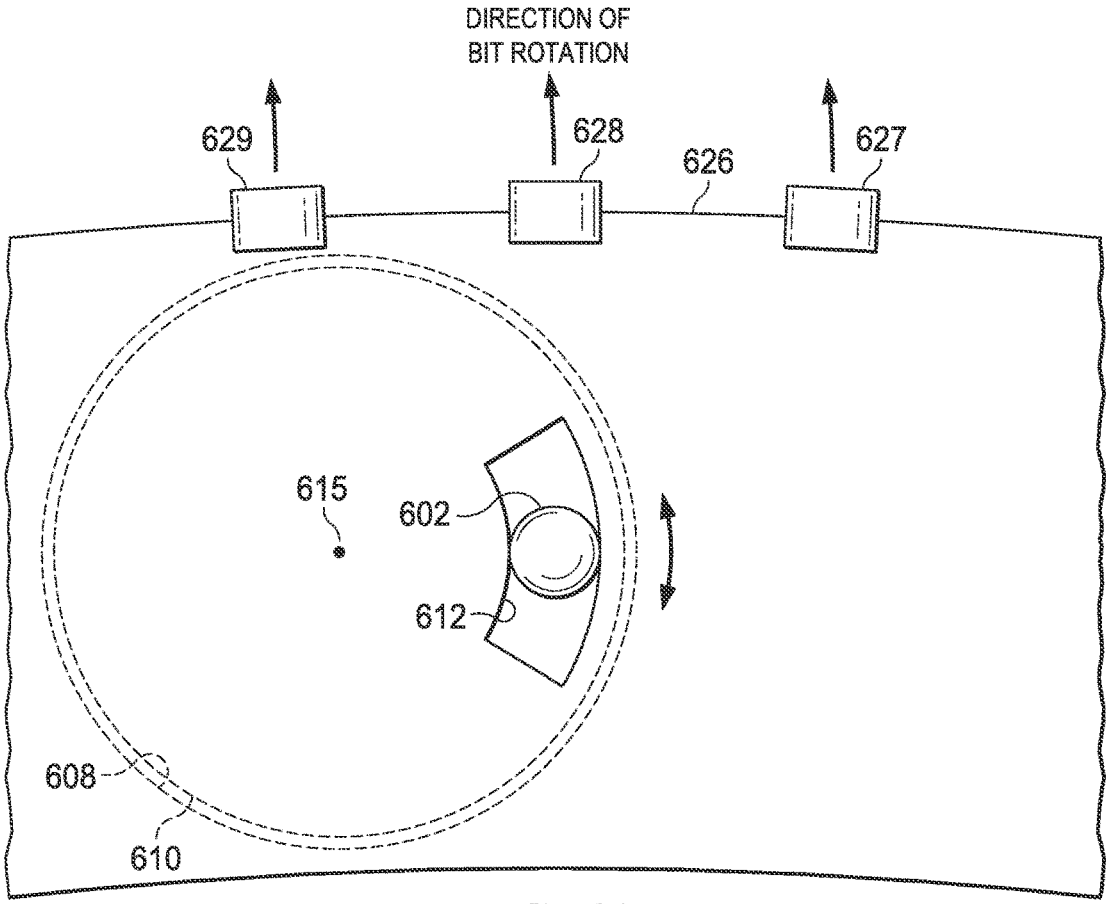
FIG. 6A illustrates a bottom view of a DOCC disposed on a portion of a blade that may be located on an downwardly oriented drill bit.
Figure 6B:
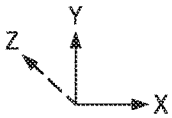
FIG. 6B illustrates a side cross-sectional view of a DOCC disposed on a portion of a blade.
Figure 6B:
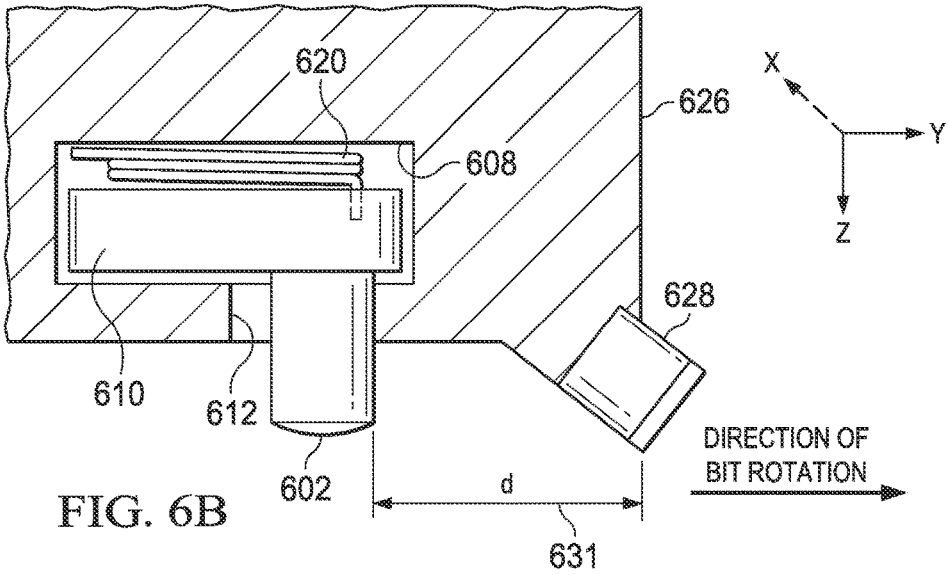

FIG. 6A illustrates a bottom view of DOCC 602 disposed on a portion of blade 626 that may be located on an downwardly oriented drill bit. FIG. 6B illustrates a side cross-sectional view of DOCC 602 disposed on a portion of blade 626.

As shown in FIG. 6A, cutting elements 627, 628, and 629 may be disposed on blade 626. Blade 626 may include slotted opening 612 through which DOCC 602 may protrude. Slotted opening 612 may span a range of positions behind cutting element 628. Further, DOCC 602 may be positioned at any location along slotted opening 612.

As shown in FIG. 6B, DOCC 602 may include base portion 610 that extends into blade 626. Base portion 610 may fit within inner cavity 608 of blade 626. Base portion 610 and inner cavity 608 may have a width that may be larger than the slotted opening 612 through which DOCC 602 may protrude. Accordingly, base portion 610 may be retained within inner cavity 608, and DOCC 602 may be coupled in an adjustable manner to blade 626.

DOCC 602 may be coupled to spring 620, which may in turn be coupled to inner cavity 608. Spring 620 may be a torsional spring and may be coupled to DOCC 602 to provide a torsional biasing force to DOCC 602. Spring 620 may provide a torsional bias to rotate base portion 610 about center point 615 and push DOCC 602 toward an end of slotted opening 612 closest to cutting element 628. During a drilling operation, a frictional force may act on DOCC 602 as a result of DOCC 602 interacting with the wellbore being drilled. Frictional force acting on DOCC 602 may operate to push DOCC 602 against the torsional biasing force of spring 620. The amount of friction acting on DOCC 602 during drilling may increase as the distance (d) 631 between DOCC 602 and the tip of cutting element 628 increases. Further, the amount of torsional force provided by spring 620 may increase as DOCC 602 is pushed back by the frictional force. Accordingly, during drilling operations, DOCC 602 may move away from cutting element 628 and along the path of slotted opening 612 to an equilibrium point where the frictional force acting on DOCC 602 due to the drilling equals the biasing force from spring 620. As shown in FIG. 6A, the path of slotted opening 612 may be curved. Accordingly, when DOCC 602 moves away from cutting element 628 in response to frictional drilling force, DOCC 602 may move along a curved path that may more closely track, as compared to a straight path behind cutting element 628, the curvature of the bit rotation.

Similar to the description above with reference to FIGS. 5A-B, the amount of depth of cut control provided by DOCC 602 may be a function of the spring constant of spring 620. Spring 620 may be implemented with any suitable torsional spring to provide a desired spring constant, and thus to provide a desired depth of cut control. Spring 620 may be implemented, for example, by a mechanical spring, by hydraulic elements, or by low modulus materials or a material with high elasticity that may deform under pressure (e.g., rubber).

Figure 7:
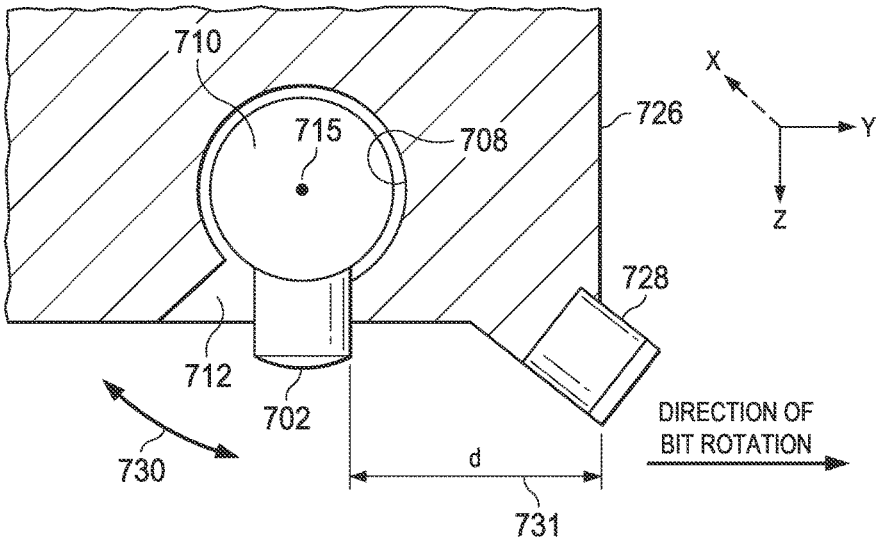
FIG. 7 illustrates a side cross-sectional view of a DOCC disposed on a portion of a blade.

FIG. 7 illustrates a side cross-sectional view of DOCC 702 disposed on a portion of blade 726. Blade 726 may include slotted opening 712 through which DOCC 702 protrudes. Slotted opening 712 may span a range of positions behind cutting element 728. Further, DOCC 702 may be positioned at any location along slotted opening 712.

As shown in FIG. 7, DOCC 702 may include base portion 710 that extends into blade 726. Base portion 710 may fit within inner cavity 708 of blade 726. Base portion 710 and inner cavity 708 may have a diameter that may be larger than the slotted opening 712 through which DOCC 702 may protrude. Accordingly, base portion 710 may be retained within inner cavity 708, and DOCC 702 may be coupled in an adjustable manner to blade 726.

DOCC 702 may be coupled to a spring (not expressly shown in FIG. 7), which may in turn be coupled to inner cavity 708. The spring may be a torsional spring and may provide a torsional biasing force to DOCC 702. The spring may provide a torsional bias to rotate base portion 710 about center point 715 and push DOCC 702 toward a front end of slotted opening 712 that may be closest to cutting element 728. During a drilling operation, a frictional force may act on DOCC 702 as a result of DOCC 702 interacting with the wellbore being drilled. Frictional force acting on DOCC 702 may cause DOCC 702 to push against the torsional biasing force of the spring. The amount of friction acting on DOCC 702 during drilling may increase as the distance (d) 731 between DOCC 702 and the tip of cutting element 728 increases. Further, the amount of torsional force provided by the spring may increase as DOCC 702 is pushed back by the frictional force. Accordingly, during drilling operations, DOCC 702 may move away from cutting element 728 and along path 730 to an equilibrium point where the frictional force acting on DOCC 702 due to the drilling equals the biasing force from the spring.

Similar to the description above with reference to FIGS. 5A-B and 6A-B, the amount of depth of cut control provided by DOCC 702 may be a function of the spring constant of the spring. The spring utilized with DOCC 702 may be implemented with any suitable torsional spring to provide a desired spring constant, and thus to provide a desired depth of cut control. For example, the spring may be implemented by a mechanical spring, by hydraulic elements, or by a low modulus material or a material with high elasticity that may deform under pressure (e.g., rubber).

Figure 8:
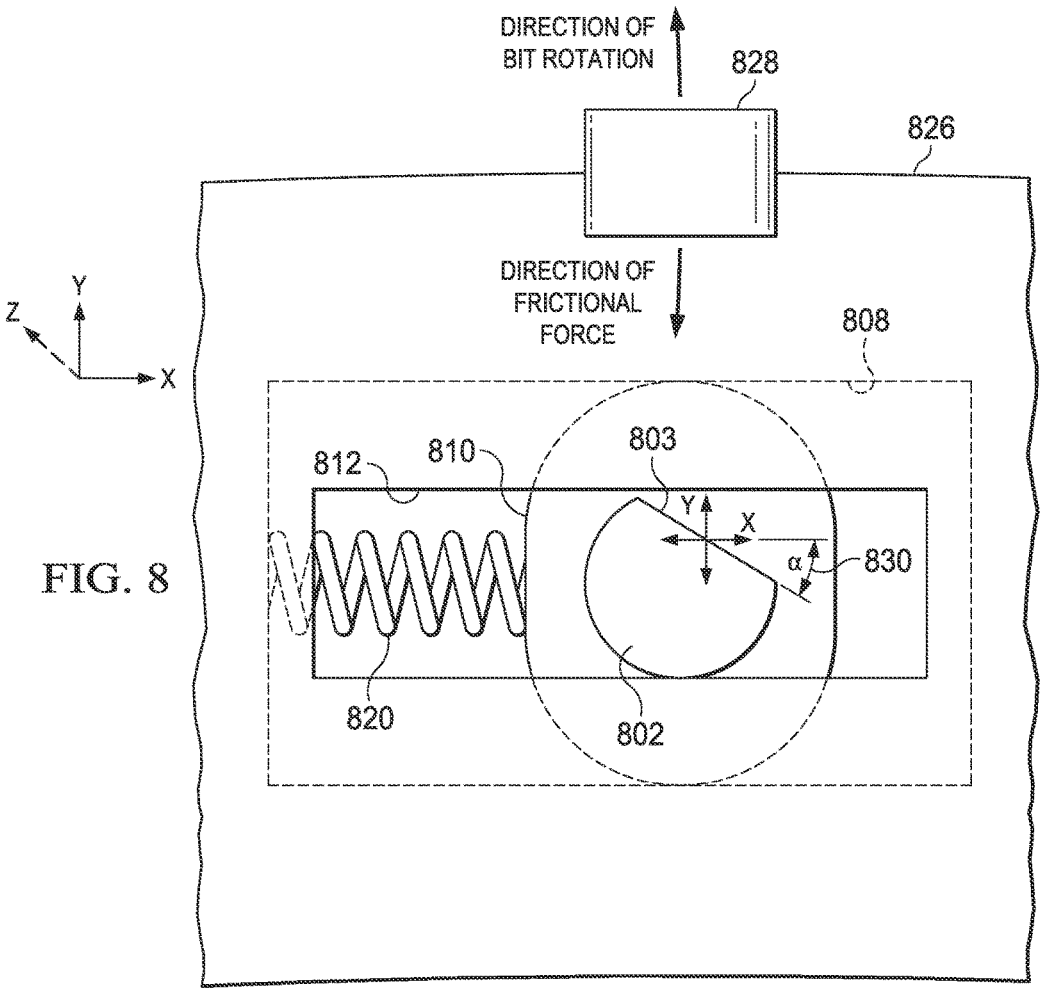
FIG. 8 illustrates a bottom view of a DOCC disposed on a portion of a blade that may be located on an downwardly oriented drill bit.

FIG. 8 illustrates a bottom view of DOCC 802 disposed on a portion of blade 826 that may be located on an downwardly oriented drill bit. Blade 826 may include a slotted opening 812 through which DOCC 802 may protrude. Slotted opening 812 may span a range of positions across a width of blade 826. Further, DOCC 802 may be positioned at any location along slotted opening 812.

As shown in FIG. 8, DOCC 802 may include base portion 810 that extends into blade 826. Base portion 810 may fit within inner cavity 808 of blade 826. Base portion 810 and inner cavity 808 may have a diameter that may be larger than the slotted opening 812 through which DOCC 802 may protrude. Accordingly, base portion 810 may be retained within inner cavity 808, and DOCC 802 may be coupled in an adjustable manner to blade 826.

DOCC 802 may be coupled to a spring 820, which may be oriented to provide a biasing force to DOCC 802. During a drilling operation, a frictional force may act on DOCC 802 as a result of DOCC 802 interacting with the wellbore being drilled. The frictional force acting on DOCC 802 may cause DOCC 802 to push against the biasing force of spring 820. For example, as shown in FIG. 8, DOCC 802 may be disposed on blade 826 with a side rake angle (α) 830. Due to the side rake of DOCC 802, a portion of the frictional force acting on face 803 of DOCC 802 may be transferred to push against the biasing force provided by spring 820. Further, the amount of biasing force provided by spring 820 may increase as spring 820 compresses. Accordingly, during drilling operations, DOCC 802 may move along an axis parallel to the x-axis to an equilibrium point where portion of the frictional force acting on DOCC 802 due to the drilling, and transferred into a direction parallel to the x-axis by the side rake of DOCC 802, equals the biasing force from spring 820.

Similar to the description above with reference to FIGS. 5A-B, 6A-B, and 7, the amount of depth of cut control provided by DOCC 802 may be a function of the spring constant of spring 820. Spring 820 may be implemented with any suitable spring to provide a desired spring constant, and thus to provide a desired depth of cut control. For example, spring 820 may be implemented by a coil spring, a Belleville spring, a wave spring, hydraulic elements, or a low modulus material or a material with high elasticity that may deform under pressure (e.g., rubber).

Figure 9:
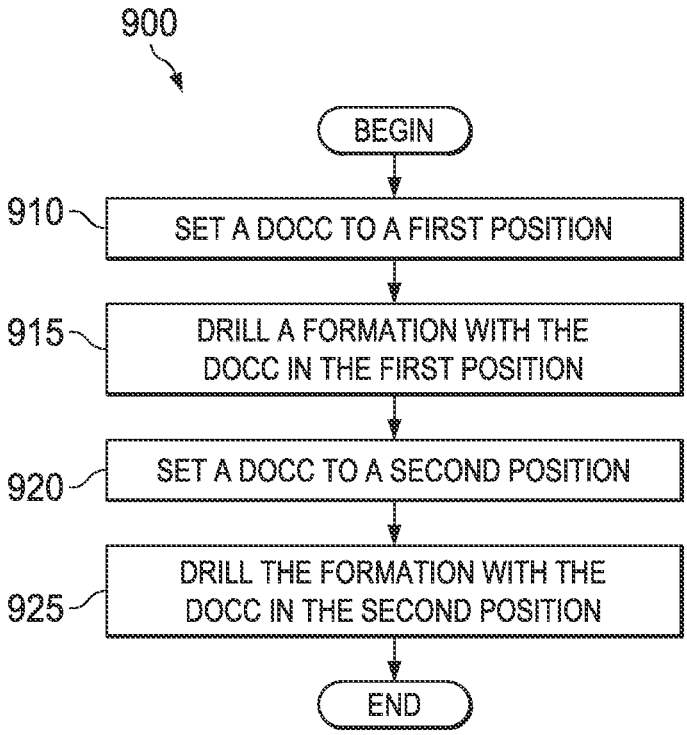
FIG. 9 illustrates a flow chart of an exemplary method for adjusting the position of a DOCC.

FIG. 9 illustrates a flow chart of exemplary method for adjusting the position of an adjustable DOCC.

Method 900 may begin and at step 910 and a DOCC may be set to a first position on a blade of a drill bit. As shown in FIG. 4A, DOCC 402 may be set to a first position behind, for example, any one of cutting elements 427, 428, or 429. The position of adjustable DOCC 402 may be adjusted by rod 414 and positioning units 416*a* and 416*b*. For example, rod 414 may be affixed to base portion 410 of DOCC 402. Positioning units 416*a* and 416*b* may each include a hydraulic chamber which may be configured to exert a hydraulic force on the respective sides of rod 414 to move DOCC 402 to a desired position on blade 426. As another example, positioning units 416*a* and 416*b* may include a motor. Rod 414 may be threaded and may extend through a threaded channel of DOCC 402. For example, as shown in FIG. 4B, a threaded implementation of rod 414 may extend through threaded channel 406 of base portion 410 of DOCC 402. The threads of threaded channel 406 may engage with the threads of rod 414. Accordingly, the position of DOCC 402 along the x-axis may be adjusted when rod 414 is rotated by the one or more motors in positioning units 416*a* and/or 416*b*.

At step 915, a subterranean formation may be drilled with the DOCC in the first position on the blade of the drill bit. A first amount of depth of cut control may be optimal during a first drilling run in which the drill bit cuts through a layer of a first type of rock in a subterranean formation. Accordingly, the first drilling run may be performed with the position of DOCC 402 set to the first position (e.g., behind cutting element 428) to provide the desired first amount of depth of cut control during the first drilling run.

At step 920, the DOCC may be set to a second position on the blade of a drill bit. For example, the setting of DOCC 402 to a second position (e.g., behind cutting element 429) may occur between two drilling runs while the rotation of the drill bit may have ceased. Positioning units 416*a* and 416*b* may receive control signals from a control unit for setting the position of adjustable DOCC 402. Such a control unit may be located, for example, at the surface of a drilling rig (e.g., drilling rig 102 as shown in FIG. 1) and may transmit control signals down a drill string to the drill bit on which blade 426 may be disposed. The control signals may instruct positioning units 416*a* and 416*b* to set DOCC 402 to a second position, which may correspond to a second amount of depth of cut control that may be desired for cutting through a layer of a second type of rock in the subterranean formation.

At step 925, the subterranean formation may be drilled with the DOCC in the second position on the blade of the drill bit. As described above with reference to step 920, the second position may correspond to a second amount of depth of cut control that may be desired for cutting through a layer of a second type of rock in the subterranean formation.

Subsequently, method 900 may end. Modifications, additions, or omissions may be made to method 900 without departing from the scope of the disclosure. For example, the order of the steps may be performed in a different manner than that described and some steps may be performed at the same time. Additionally, each individual step may include additional steps without departing from the scope of the present disclosure.

Embodiments herein may include:

A. A drill bit that includes, a bit body, a plurality of blades on the bit body, a plurality of cutting elements on the plurality of blades, an adjustable depth of cut controller (DOCC) located on a blade to provide depth of cut control for at least one of the plurality of cutting elements, and a positioning unit coupled to the adjustable DOCC and configured to adjust the position of the DOCC relative to the cutting element based on a control signal from a control unit.

B. A drill bit that includes a bit body, a blade on the bit body, a cutting element on the blade, a depth of cut controller (DOCC) located on the blade to control the depth of cut of the cutting element, and a spring coupled to the DOCC to provide a biasing force to the DOCC.

C. A method that includes setting a depth of cut controller (DOCC) to a first position on a blade of a drill bit, drilling a subterranean formation with the DOCC in the first position on the blade of the drill bit, setting the DOCC to a second position on the blade of the drill bit, and drilling the subterranean formation with the DOCC in the second position on the blade of the drill bit.

Each of embodiments A, B, and C may have one or more of the following additional elements in any combination:

Element 1: wherein the positioning unit includes a rod coupled to a base portion of the adjustable DOCC. Element 2: the drill bit further includes a threaded channel in the adjustable DOCC, and a threaded rod engaged with the threaded channel. Element 3: wherein the positioning unit comprises an electric motor. Element 4: wherein the positioning unit comprises a hydraulic pump. Element 5: the blade includes a slotted opening, the slotted opening includes a plurality of DOCC positions, a first of the plurality of DOCC positions overlaps a radial location of a first of the plurality of cutting elements, and a second of the plurality of DOCC positions overlaps a radial location of a second of the plurality of cutting elements. Element 6: wherein the positioning unit is oriented on the blade to adjust the position of the adjustable DOCC along an axis that is approximately perpendicular to a direction of bit rotation. Element 7: wherein the positioning unit is oriented on the blade to adjust the position of the adjustable DOCC along an axis that is approximately tangential to an arc of a rotational path of the drill bit. Element 8: wherein an equilibrium position of the DOCC during a drilling operation is based on the biasing force of the spring and a frictional force incurred by the DOCC. Element 9: wherein the biasing force of the spring and the frictional force are approximately equal at the equilibrium position. Element 10: wherein the spring is oriented to provide a biasing force to the DOCC in a direction that is approximately opposite to a direction of a frictional force incurred by the DOCC during drilling. Element 11: wherein the spring comprises one of a coil spring, a Belleville spring, a wave spring, a hydraulic element, or a low modulus material. Element 12: wherein the spring is coupled to the DOCC to provide a torsional biasing force to the DOCC. Element 13: wherein the spring comprises one of a torsional spring, a hydraulic element, or a low modulus material. Element 14: wherein the DOCC is disposed on the blade with a side-rake, the spring is oriented to provide a biasing force that is approximately perpendicular to a direction of bit rotation, and an equilibrium position of the DOCC, during a drilling operation, along a path approximately perpendicular to the direction of bit rotation, is based on the biasing force and a component of the frictional force, at a face of the DOCC, that is approximately perpendicular to the direction of bit rotation. Element 15: the method further including transmitting a control signal to a positioning unit of the drill bit, and adjusting the position of the DOCC from the first position to the second position based on the control signal. Element 16: wherein the DOCC provides a first amount of depth of cut control when the DOCC is set to the first position, and the DOCC provides a second amount of depth of cut control when the DOCC is set to the second position. Element 17, wherein the first amount of depth of cut control is based on a first type of rock in the subterranean formation to be drilled when the DOCC is in the first position, and the second amount of depth of cut control is based on a second type of rock in the subterranean formation to be drilled when the DOCC is in the second position.

Although the present disclosure has been described with several embodiments, various changes and modifications may be suggested to one skilled in the art. For example, although the present disclosure describes the configurations of depth of cut controllers with respect to drill bits, the same principles may be used to with depth of cut controllers on any suitable drilling tool according to the present disclosure. It is intended that the present disclosure encompasses such changes and modifications as fall within the scope of the appended claims.

What is claimed is:

1. A drill bit, comprising:
a bit body;
a plurality of blades on the bit body;
a plurality of cutting elements on the plurality of blades;
an adjustable depth of cut controller (DOCC) located on a blade to provide depth of cut control for at least one of the plurality of cutting elements;
a threaded channel in the adjustable DOCC;
a threaded rod engaged with the threaded channel; and
a positioning unit coupled to the adjustable DOCC and configured to adjust the position of the DOCC relative to the cutting element based on a control signal from a control unit.

2. The drill bit of claim 1, wherein the positioning unit includes the threaded rod coupled to a base portion of the adjustable DOCC.

3. The drill bit of claim 1, wherein the positioning unit comprises an electric motor.

4. The drill bit of claim 1, wherein the positioning unit comprises a hydraulic pump.

5. The drill bit of claim 1, wherein:
the blade includes a slotted opening;
the slotted opening includes a plurality of DOCC positions;
a first of the plurality of DOCC positions overlaps a radial location of a first of the plurality of cutting elements; and
a second of the plurality of DOCC positions overlaps a radial location of a second of the plurality of cutting elements.

6. The drill bit of claim 1, wherein the positioning unit is oriented on the blade to adjust the position of the adjustable DOCC along an axis that is approximately perpendicular to a direction of bit rotation.

7. The drill bit of claim 1, wherein the positioning unit is oriented on the blade to adjust the position of the adjustable DOCC along an axis that is approximately tangential to an arc of a rotational path of the drill bit.

8. A drill bit, comprising:
a bit body;
a blade on the bit body;
a cutting element on the blade;
a depth of cut controller (DOCC) located on the blade to control the depth of cut of the cutting element; and
a spring coupled to the DOCC to provide a biasing force to the DOCC, wherein the spring is oriented to provide a biasing force in a direction on the radial plane of the cutting element.

9. The drill bit of claim 8, wherein an equilibrium position of the DOCC during a drilling operation is based on the biasing force of the spring and a frictional force incurred by the DOCC.

10. The drill bit of claim 9, wherein the biasing force of the spring and the frictional force are approximately equal at the equilibrium position.

11. The drill bit of claim 8, wherein the spring is oriented to provide a biasing force to the DOCC in a direction that is approximately opposite to a direction of a frictional force incurred by the DOCC during drilling.

12. The drill bit of claim 11, wherein the spring comprises one of a coil spring, a Belleville spring, a wave spring, a hydraulic element, or a low modulus material.

13. The drill bit of claim 8, wherein the spring is coupled to the DOCC to provide a torsional biasing force to the DOCC.

14. The drill bit of claim 13, wherein the spring comprises one of a torsional spring, a hydraulic element, or a low modulus material.

15. The drill bit of claim 8, wherein:
the DOCC is disposed on the blade with a side-rake;
the spring is oriented to provide a biasing force that is approximately perpendicular to a direction of bit rotation; and
an equilibrium position of the DOCC, during a drilling operation, along a path approximately perpendicular to the direction of bit rotation, is based on the biasing force and a component of the frictional force, at a face of the DOCC, that is approximately perpendicular to the direction of bit rotation.

16. A method, comprising:
setting a depth of cut controller (DOCC) to a first position on a blade of a drill bites actuating a threaded rod engaged with a threaded channel of the DOCC;
drilling a subterranean formation with the DOCC in the first position on the blade of the drill bit;
setting the DOCC to a second position on the blade of the drill bit by actuating the threaded rod engaged with the threaded channel of the DOCC; and drilling the subterranean formation with the DOCC in the second position on the blade of the drill bit.

17. The method of claim 16, further comprising:

transmitting a control signal to a positioning unit of the drill bit; and adjusting the position of the DOCC from the first position to the second position based on the control signal.

18. The method of claim 16, wherein:

the DOCC provides a first amount of depth of cut control when the DOCC is set to the first position; and the DOCC provides a second amount of depth of cut control when the DOCC is set to the second position.

19. The method of claim 16, wherein:

the first amount of depth of cut control is based on a first type of rock in the subterranean formation to be drilled when the DOCC is in the first position; and the second amount of depth of cut control is based on a second type of rock in the subterranean formation to be drilled when the DOCC is in the second position.

* * * * *